US011375787B2

(12) United States Patent
Harrison

(10) Patent No.: US 11,375,787 B2
(45) Date of Patent: Jul. 5, 2022

(54) HAIR CARRYING DEVICE

(71) Applicant: Ecouia Harrison, Sacramento, CA (US)

(72) Inventor: Ecouia Harrison, Sacramento, CA (US)

( * ) Notice: Subject to any disclaimer, the term of this patent is extended or adjusted under 35 U.S.C. 154(b) by 366 days.

(21) Appl. No.: 16/021,394

(22) Filed: Jun. 28, 2018

(65) Prior Publication Data

US 2020/0000196 A1 Jan. 2, 2020

(51) Int. Cl.

| | |
|---|---|
| ***A45C 13/03*** | (2006.01) |
| ***A45D 8/20*** | (2006.01) |
| ***A47F 7/06*** | (2006.01) |

(52) U.S. Cl.

CPC ..... *A45C 13/03* (2013.01); *A45D 8/20* (2013.01); *A47F 7/065* (2013.01)

(58) Field of Classification Search

CPC ..... A45C 13/03; A45D 8/20; A47F 7/065
See application file for complete search history.

(56) References Cited

U.S. PATENT DOCUMENTS 505,688 A * 9/1893 Wendell
1,681,922 A * 8/1928 Boch ..... A45C 3/00 383/39
2,522,604 A * 9/1950 Courter ..... A45B 25/24 135/34.2
2,865,418 A * 12/1958 Bourdon ..... A45C 3/00 206/287
3,550,161 A * 12/1970 Orozco ..... A42B 1/004 2/172
3,550,663 A * 12/1970 Johnston ..... A45C 3/06 150/103
4,182,391 A * 1/1980 Kjose ..... A63B 55/40 224/581
4,301,849 A * 11/1981 Litwack ..... A45C 3/06 150/103
5,046,860 A * 9/1991 Brennan ..... A45C 13/02 383/38
5,090,559 A * 2/1992 Gendreau ..... D06F 95/002 206/278
5,152,441 A * 10/1992 Torena ..... A45C 15/00 206/373
5,209,385 A * 5/1993 Ledesma ..... A45C 1/04 224/223
5,323,802 A * 6/1994 Kiedrowski ..... A45B 25/28 135/34.2
5,427,239 A * 6/1995 Hunt ..... B25H 3/00 190/125

(Continued)

*Primary Examiner* — Tri M Mai
(74) *Attorney, Agent, or Firm* — The Law Firm of Andrea Hence Evans, LLC

(57) ABSTRACT

Certain embodiments of the disclosure may include devices, systems and methods for carrying hair pieces and coupling the hair pieces to an embodiment of the disclosure. According to an example embodiment of the disclosure, a hair carrying device can include a collapsible container having an internal surface and an external surface. The internal surface can include a top internal surface side, and external surface can include a top external surface side. The top internal surface side and the top external surface side can be coupled and define an opening comprising an area. The embodiment can also include at least one clamping device coupled to the internal surface.

8 Claims, 12 Drawing Sheets

(56) References Cited

U.S. PATENT DOCUMENTS

| | | | | |
|---|---|---|---|---|
| 5,533,809 | A * | 7/1996 | Gorman | B65D 33/14 383/11 |
| 5,558,106 | A | 9/1996 | Der | |
| 5,595,199 | A * | 1/1997 | Solomon | A45D 8/00 132/273 |
| 5,653,337 | A * | 8/1997 | Cirigliano | A45C 9/00 206/373 |
| 5,813,418 | A | 9/1998 | Pillars | |
| 5,813,445 | A * | 9/1998 | Christman | A63F 3/06 150/106 |
| 6,808,066 | B2 * | 10/2004 | Bean | A45C 11/00 150/165 |
| 6,966,439 | B2 * | 11/2005 | Weleczki | A45C 7/0077 206/315.3 |
| 7,946,425 | B2 * | 5/2011 | Hayes Burnett | A45C 5/005 206/581 |
| 8,011,500 | B2 * | 9/2011 | Lee | A45C 3/04 206/216 |
| D766,550 | S * | 9/2016 | Coggins | D2/866 |
| 10,306,970 | B2 * | 6/2019 | Calabrese | A45D 44/02 |
| 2005/0028909 | A1 * | 2/2005 | Matlhako | A45C 13/26 150/107 |
| 2007/0151871 | A1 * | 7/2007 | Brawley | A45C 11/24 206/37 |
| 2011/0284397 | A1 | 11/2011 | Batres et al. | |
| 2013/0048006 | A1 | 2/2013 | Springfield-Thomas | |
| 2013/0206628 | A1 * | 8/2013 | Batres | A45C 13/001 206/457 |
| 2015/0351574 | A1 | 12/2015 | Eslami et al. | |

* cited by examiner

HAIR CARRYING DEVICE

TECHNICAL FIELD

Embodiments of this disclosure relate generally to a hair carrying device for transporting and protecting hair and a method for protecting the hair.

BACKGROUND

Hair extensions, wigs, and other hair pieces can be used as cosmetic enhancements. These devices comprise natural human hair, synthetic hair or a combination of both. In recent years, the economic impact of these hair products has increased the reach in global markets for the trafficking of these goods. The economic impact has also increased the cost to acquire and maintain these hair products. In efforts to protect their hair products, customers have sought means to maintain and transport their hair. Accordingly, there exists a need for methods and/or devices that can protect and transport hair extensions, wigs and other hair pieces.

SUMMARY

Some or all of the above needs and/or problems may be addressed by certain embodiments of the disclosure. Certain embodiments of the disclosure can include devices for protecting and carrying hair. An embodiment of the hair carrying device can include a collapsible container having an internal surface and an external surface. The internal surface can include a top internal surface side and the external surface can include a top external surface side. The top internal surface side and the top external surface side can be coupled and define an opening comprising an area. The embodiment can also include at least one clamping device coupled to the internal surface.

In another embodiment, the hair carrying device can include a bag comprising a top edge; a bottom edge, a first side edge, and a second side edge. The bottom edge can oriented opposite the top edge. The first side edge can be oriented opposite the second side edge. The first side edge can be adjacent to the top edge and bottom edge. The second side edge can be oriented adjacent the bottom edge and the top edge. The top edge, the bottom edge, the first side edge and the second side edge define an external surface and an internal surface. The external surface and the internal surface can be coupled and define an opening into the bag. The embodiment can also include at least one clamping device coupled to the internal surface. The embodiment can further include a securing system configured to couple to the internal surface.

According to another example embodiment, a method for protecting the hair can include adjusting the area of the opening of the collapsible container; reaching into the opening of the collapsible container; grabbing an internal surface of the collapsible container; pulling the internal surface through the opening; and coupling the hair piece to the internal surface by at least one clamping device.

BRIEF DESCRIPTION OF THE DRAWINGS

The detailed description is set forth with reference to the accompanying drawings, which are not necessarily drawn to scale.

DETAILED DESCRIPTION OF THE DISCLOSURE

Figure 1:
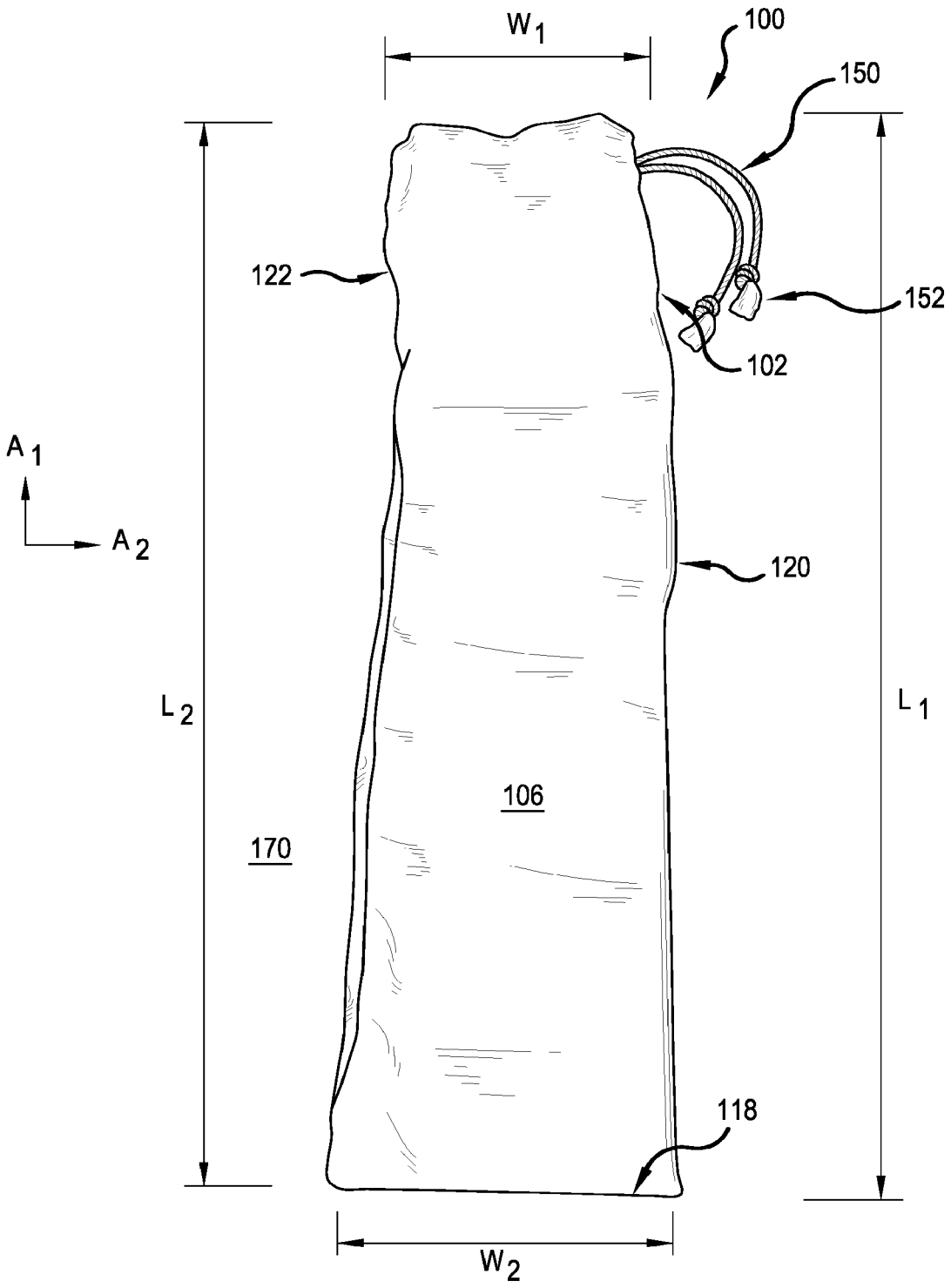
FIG. 1 shows a top perspective view of an illustrative embodiment of the disclosure.

Illustrative embodiments of the disclosure will now be described more fully hereinafter with reference to the accompanying drawings, in which some, but not all embodiments of the disclosure are shown. The disclosure may be embodied in many different forms and should not be construed as limited to the embodiments set forth herein; rather, these embodiments are provided so that this disclosure will satisfy applicable legal requirements.

Whenever appropriate, terms used in the singular also will include the plural and vice versa. The use of "a" herein means "one or more" unless stated otherwise or where the use of "one or more" is clearly inappropriate. The use of "or" means "and/or" unless stated otherwise. The use of "comprise," "comprises," "comprising," "include," "includes," and "including" are interchangeable and not intended to be limiting. The term "such as" also is not intended to be limiting. For example, the term "including" shall mean "including, but not limited to."

The following description is provided as an enabling teaching of the disclosed articles, systems, and methods in their best, currently known embodiments. To this end, those skilled in the relevant art will recognize and appreciate that many changes can be made to the various aspects of the articles, systems, and methods described herein, while still obtaining the beneficial results of the disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "a gasket" can include two or more such gaskets unless the context indicates otherwise.

As used throughout, "substantially" with respect to a measure can refer to a range of values. For example, substantially orthogonal, normal, or parallel can include embodiments, where the referenced components are oriented +/−10 degrees of being classified as orthogonal, normal, or parallel respectively.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

As used herein, the word proximal can define a distance between an initial point and an end point that is less than the distance between the initial point and a midpoint, located equidistant between the initial point and the endpoint. Similarly, the term distal can define can define a distance between the initial point and the end point that is greater than the distance between the initial point and the midpoint.

The word hair or hair piece can refer to any type of device of hair device, which includes but not limited to: hair extensions, wigs, weave, falls, toupees, loose hair, braids, etc.

Figure 2:
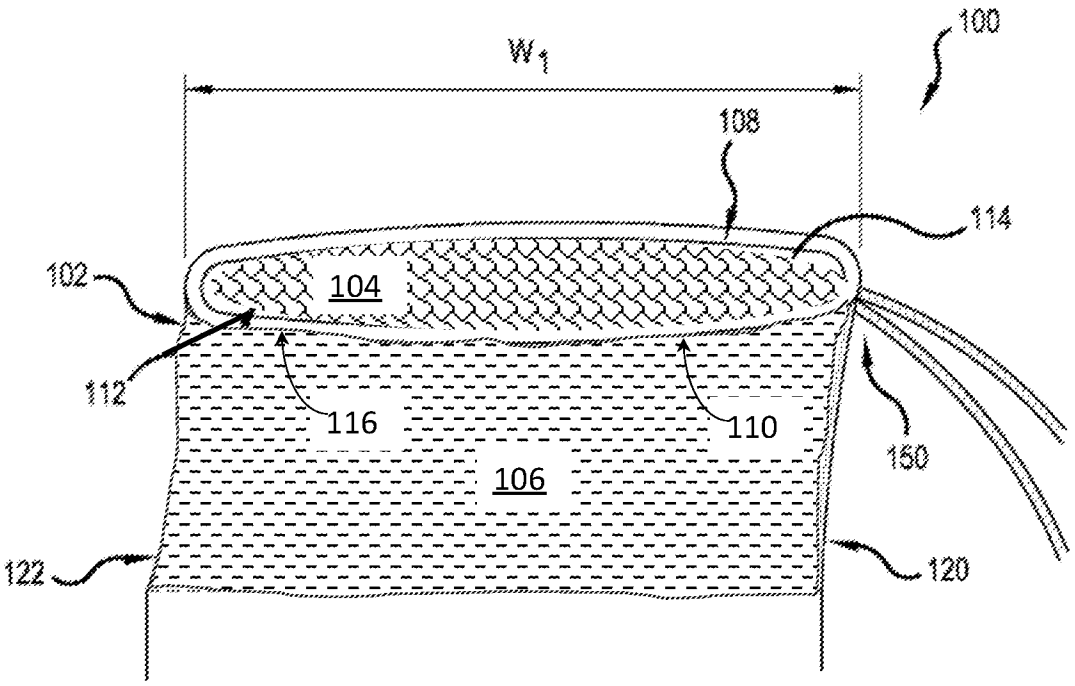
FIG. 2 shows a partial top perspective view of an illustrative embodiment of the disclosure.
Figure 3:
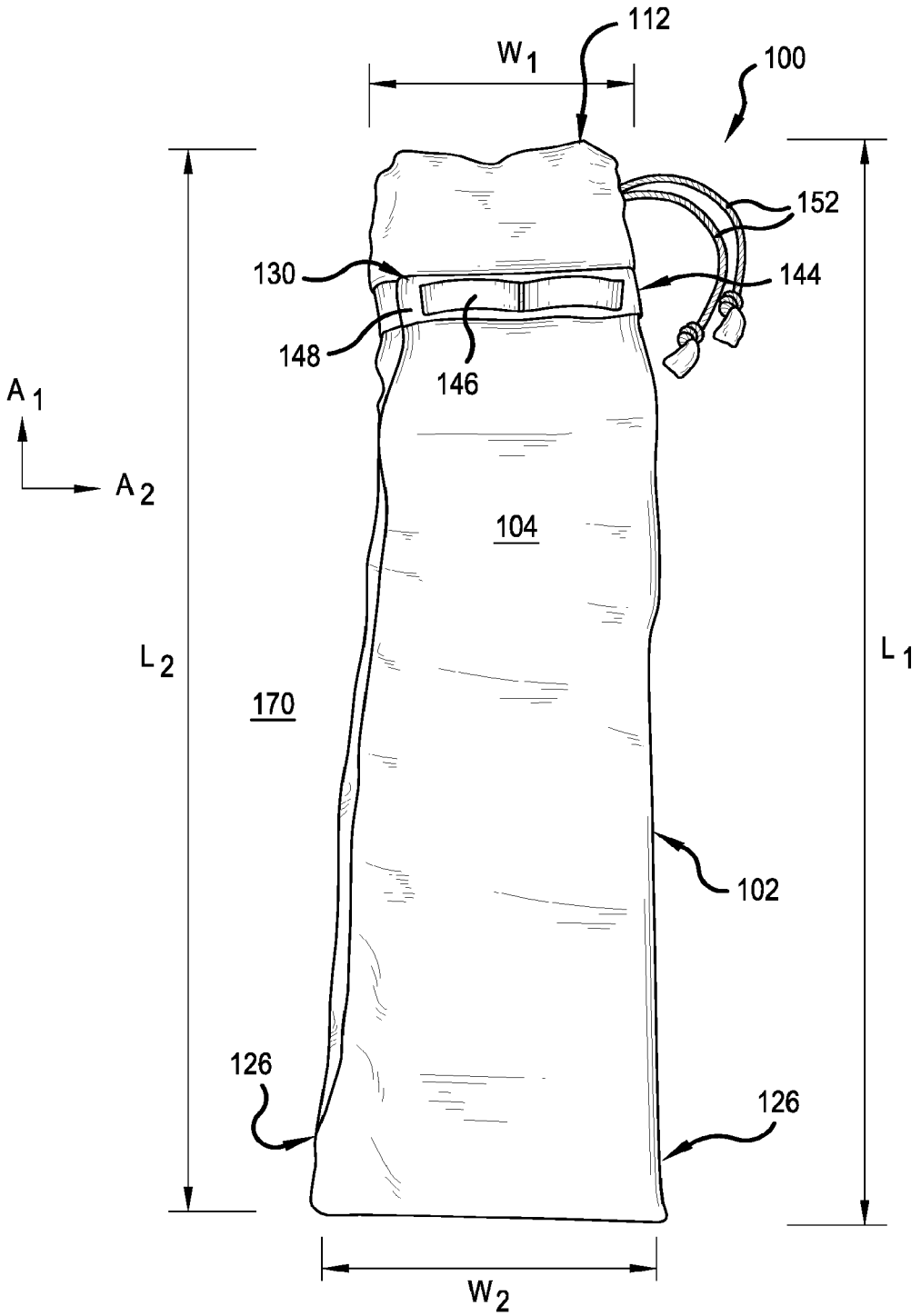
FIG. 3 shows a top perspective view of an illustrative embodiment of FIG. 1 in an inverted orientation.
Figure 4:
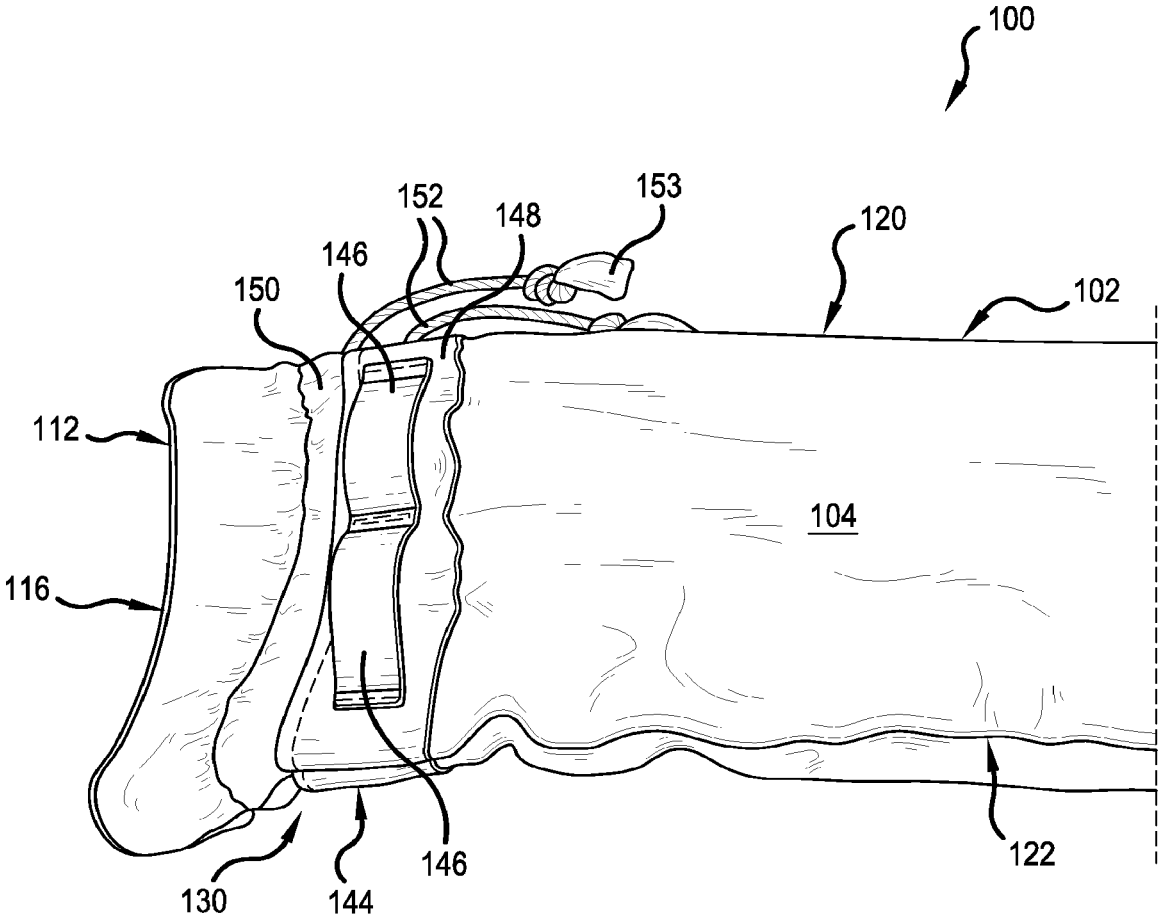
FIG. 4 shows a partial top perspective view of the illustrative embodiment of FIG. 1 in an inverted orientation.
Figure 5:
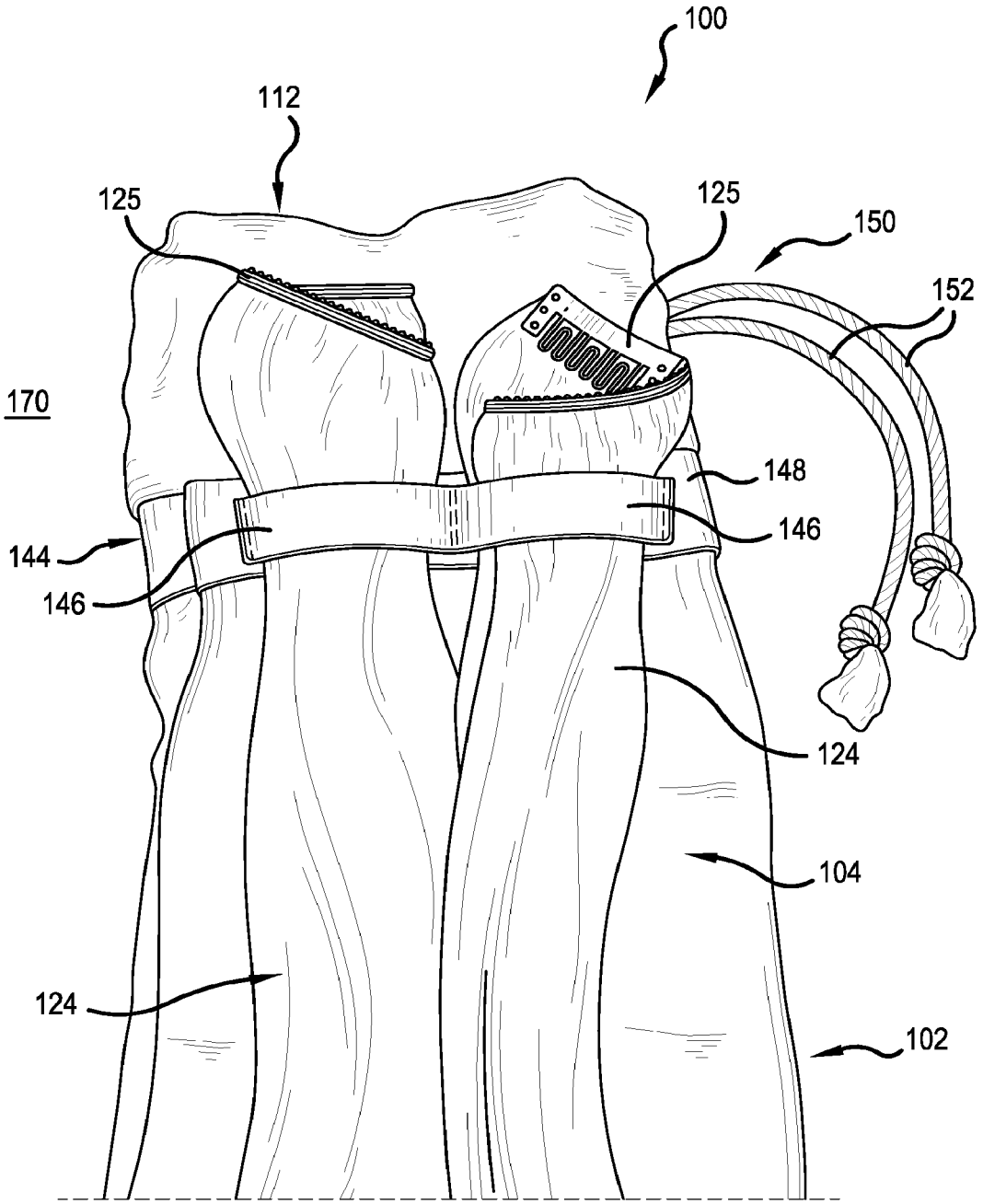
FIG. 5 shows a partial top perspective view of the illustrative embodiment of FIG. 1 with a hair piece in an inverted orientation.

As shown in FIGS. 1 and 2, a hair carrying device 100 can comprise a collapsible container 102. The collapsible container 102 can have an internal surface 104 and an external surface 106. The internal surface 104 can have a top internal surface side 108, while the external surface 106 can have a top external surface side 110. The top internal surface side 108 and the top external surface side 110 can be coupled and define an opening 112. In another aspect, the collapsible container 102 can be a bag. The bag 102 can comprise a top edge 116 having a width dimension W1. The first side edge 120 can have a length dimension L1. The bag 102 can further have a bottom edge 118 with a width dimension W2. The bag can also have second side edge 122 that can have a length dimension L2. The bag 102 can be structurally oriented such that the first side edge 120 is adjacent to the top edge 116 and the bottom edge 118. Also, the bottom edge 118 can be oriented adjacent to the first side edge 116 and the second side edge 122. The second side edge 122 can also be oriented adjacent to the top edge 116.

In a further aspect of the embodiment, the top edge 116 can be oriented such that it is opposite the bottom edge 118. The first side edge 120 and the second side edge 122 can be oriented to be opposite each other. In another aspect, theses adjacent edges can define multiple surfaces with corresponding area dimensions. One example surface can be the external surface 106, which can be viewed from the exterior of the bag 102. Further, the bag 102 can include an internal surface 104. The area dimensions of the internal surface 104 and external surface 106 can be determined from the dimensions of the edges that circumscribe these surfaces 104, 106. Further, the internal surface 104 can have dimensions about the same as the external surface 106 because the internal surface can be circumscribed by the same dimensions (L1, L2, W1, and W2) as the external surface.

In another aspect of the embodiment, the top edge 116 can define an opening 112. The opening 112 can provide a conduit from the exterior of the bag 102 into a cavity 114 of the bag. In a further aspect, the cavity 114 can be spatially defined by the internal surface 104 that envelopes the cavity. In another aspect, the cavity 114 can be defined by the external surface 106 when the bag 102 is manipulated into an inverted configuration, as shown in FIGS. 3-6 and 8-11. One example of an inverted configuration (inside-out) can occur when then internal surface 104 is pulled through the opening 112, exposing the internal surface to the exterior space surrounding the bag 102; in the same process, the external surface 106 is pulled through the opening to redefine the spatial parameters of the cavity 114.

In a further embodiment, the bag 102 have a rectangular prism-like shape, where the W1 and W2 dimensions are about the same and the top edge 116 and the bottom edge 118 are substantially parallel, while L1 and L2 dimensions are about the same as the first side edge 120 and the second side edge 122 are substantially parallel to each other. Other geometric orientations of the respective sides are contemplated as well. The variable configurations can address the variety of potential hair piece 124 options. For example, a bag 102 can have a trapezoidal shape, where W1<W2 and the top edge 116 and the bottom edge 118 are substantially parallel to each other. The trapezoidal shape can allow for hair extensions to flair distally away from a hair piece's attachment fixture (comb) 125, located proximal to the bag opening 112, without damaging portions of the hair piece 124 located distally from the bag opening. In another example, the edges 116, 118, 120, 122 can have rounded or arch-type shapes such that the bag 102 can have a curved or rounded shape. A hair piece 124 with a circular hair style or wig may be better suited for a bag 102 with a rounded shape to avoid any unintentional folding.

As mentioned earlier, the hair piece 124 can come in a variety of lengths and widths. To accommodate the various size of the hair piece, the L1 dimension of the first side edge 120 and the L2 dimension of the second side edge 122 can range from about 12 in. to 42 in. Optionally, in exemplary aspects, L1 and L2 can range from about 16 in. to 36 in. or optionally, from about 20 in. to 30 in. Similarly, the W1 and W2 dimensions can range from about 6 in. to 20 in. Optionally, in exemplary aspects, W1 and W2 can range from about 12 in. to 18 in. or optionally from about 14 in. to 16 in. It is further contemplated that the bag 102 can have any combination of the dimensions of L1, L2, W1 and W2 in the aforementioned ranges.

In other example embodiments, the internal surface 104 can be in contact with the hair piece 124. The internal surface 104 can be configured to protect the hair piece 124 based on the material that can comprise the internal surface. In a further aspect, the materials that comprise the internal surface 104 can be non-abrasive. For example, the internal surface 104 can be comprised of silk, polyester, rayon, nylon, plastic, cotton fabric, vinyl, microfiber, canvas, fleece, wool, chamois, woven fabric, suede or imitations of the aforementioned fabrics. While in contact with any combination of the aforementioned materials, the hair piece 124 can be transported with reduced abrasive or fraying type damage to the hair. Further, some of these non-abrasive materials can increase the luster and shine of the hair in the hair pieces 124 by polishing the hair while the hair moves within the bag 102. In one aspect, the external surfaces 106 can also be comprised of a different material as the internal surface 104. In a further aspect, using the same assortment of non-abrasive materials in the external surface 106 can reduce the risk of the damage as the hair pieces 124 are inserted from the exterior of the bag 102 into the interior surface 104.

In an aspect, constructing the bag out of non-abrasive fabrics and the orientation of the internal surface 104 and outer surface 106 can make the bag 102 invertible. An invertible bag 102 can be manipulated such that the internal surface 104 can be pulled through the opening 112. As shown in FIGS. 3-6 and 8-11, once the bag manipulation is complete, the internal surface 104 can be positioned on the exterior of the bag 102. For example, in one aspect shown in FIGS. 3 and 8, the internal surface 104 can be attached to the external surface 106 by at least one attachment stitch 126 located distally from the opening. When the bag 102 is inverted to expose the internal surface 104 to the exterior space 170, the attachment stitch 126 can maintain the opposing orientation of the internal surface 104 and external surface 106. Similarly, when the bag 102 is returned to a normal orientation, such that the internal surface 104 is spatially oriented in the interior of the bag, the attachment stitch 126 can continue to maintain the opposing orientation of the internal surface 104 and external surface 106.

In a further aspect, the fabrics that comprise the bag 102 can allow the bag to be collapsible. The collapsible container or bag 102 can reduce the size of the cavity 114 defined by the internal surface 104 and external surface 106. Prior to being affixed to a customer's head, hair pieces 124 might be prepped. This preparation step for the hair piece can include: washing, dyeing, drying and brushing. However, the brushing step can be the most physically exhaustive step because the hair dresser may be required to remove entanglements and folds introduced during transportation. The current disclosure reduces the folds and entanglements because the bag 102 can be collapse by rolling the various edges along the primary axis A1 or secondary axis A2.

Figure 8:
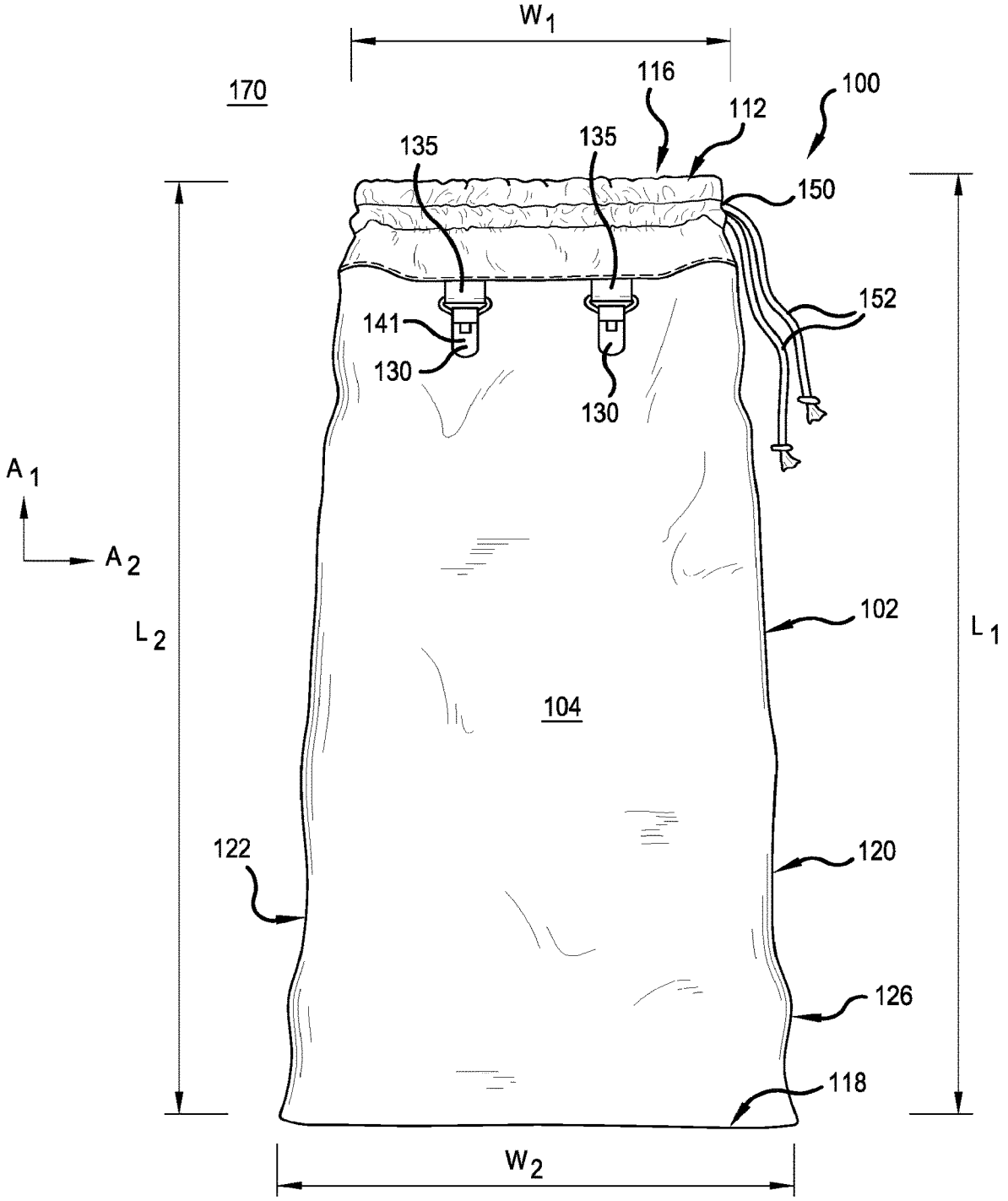
FIG. 8 shows a top perspective view of the illustrative embodiment in FIG. 7 in an inverted orientation.
Figure 9:
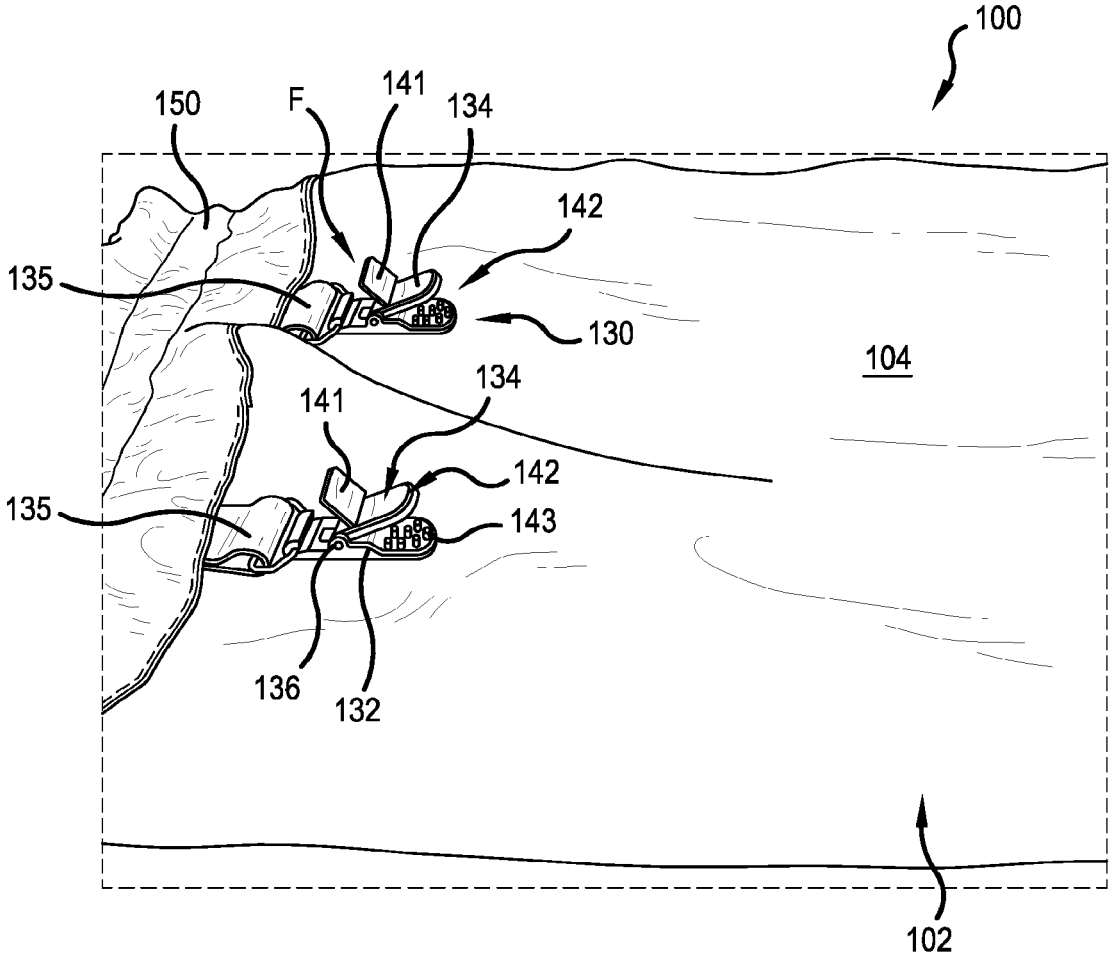
FIG. 9 shows a partial side perspective view of the illustrative embodiment of FIG. 7 in an inverted orientation.
Figure 10:
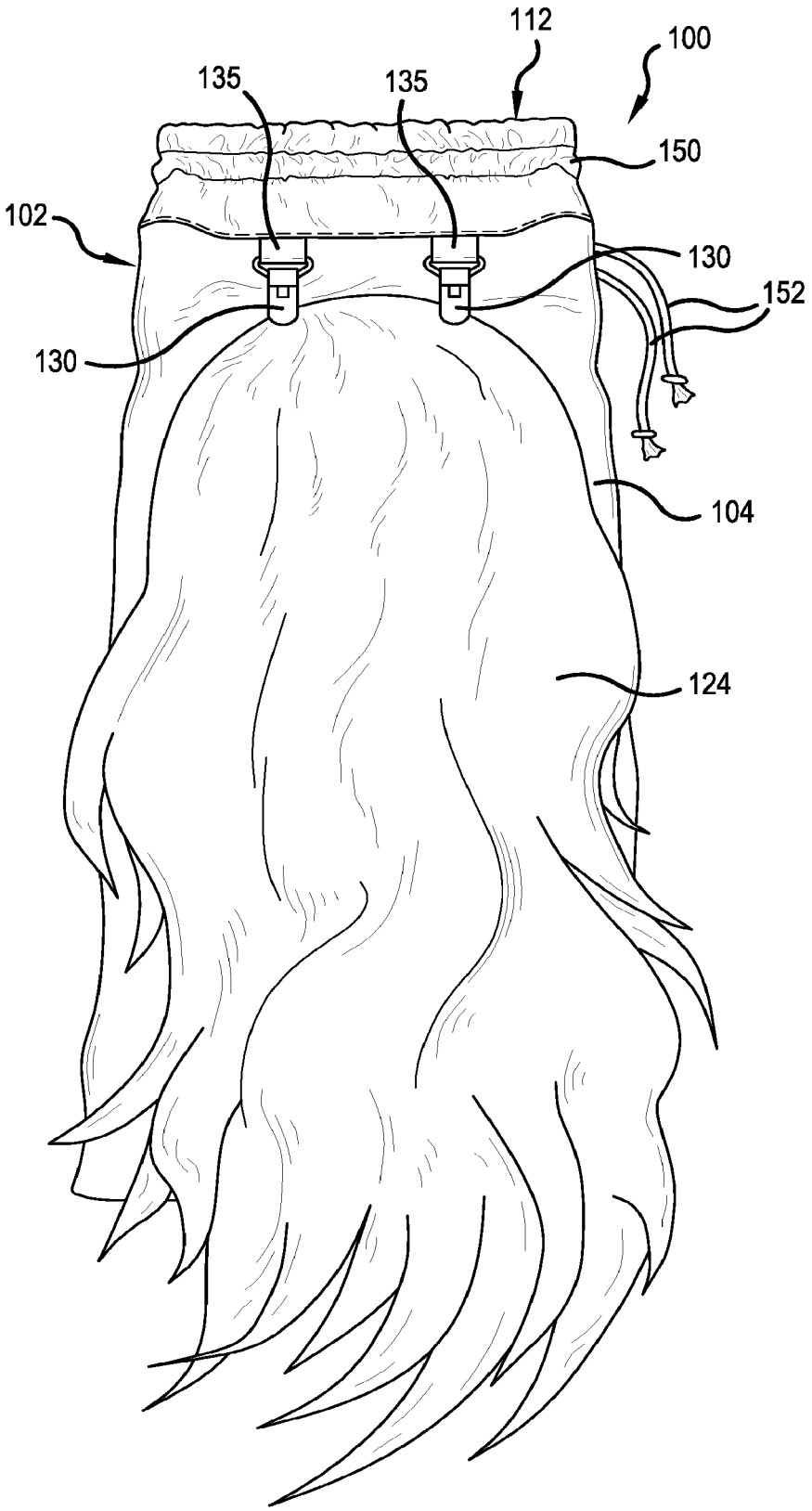
FIG. 10 shows a top perspective view of the illustrative embodiment of FIG. 7 with a hair piece in an inverted orientation.
Figure 11:
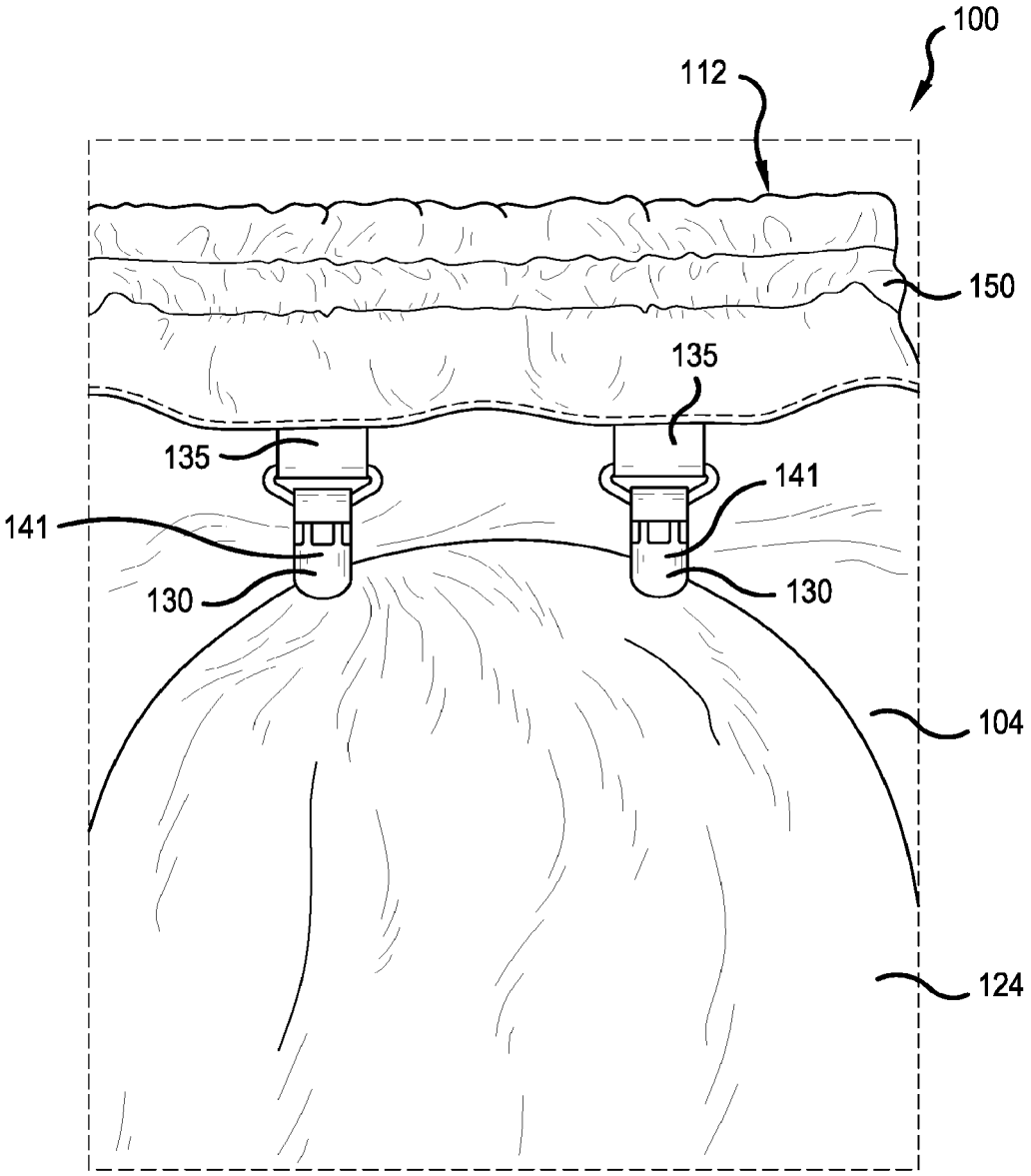
FIG. 11 shows a partial top perspective view of the illustrative embodiment of FIG. 7 in an inverted orientation.

In a further aspect of the embodiment, as shown in FIGS. 8 and 9, the clamping device 130 can be a clip including: a base arm 132, a clamp arm 134, and a rotational spring 136. Structurally, the rotational spring 136 can be placed between the base arm 132 and the clamp arm 134. The base arm 132 can be coupled to the internal surface 134 with a connector strap 135. In a further aspect, the spring 136 can be pre-tensioned, wherein the normal state of the clamping device 130 is open. The clamping device 130 can be closed by placing a force (F) at a latch 141 located above the clamp arm 134 near a grip end 142 of the clamp arm 134. In a further aspect, the grip end 142 can comprise a plurality of nodules 143 that extend away from a surface of the grip end. These nodules 143 can more effectively grab the hair piece 124

As shown in FIGS. 3-6, another embodiment of the clamping device 130 can be a strap device 144. The strap device 144 can comprise a pre-tensioned elastic band 146 wherein each end of the strap is coupled to a base 148. The base 148 can be attached to the internal surface 104 by a fastener or stitching. The hair piece 124 is secured by: stretching the elastic band 146; placing the hair piece 124 between the elastic band and the base 148; and releasing the elastic band to contact the base thereby securing the hair piece between the elastic band and the base. Any plurality of strap devices 144 can be coupled to the internal surface 104. It is further contemplated that the clamping device 130 can comprise any mechanism known or hereafter developed in the art capable of securing hair products between two members.

In another aspect, the bag 102 can include a closing device 150. In an aspect, the closing device 150 can be a mechanism that regulates the opening's area by adjusting the size of the opening. Accordingly, the closing device 150 can open and close the opening 112, adjusting the size of the opening. In a further aspect, the closing device can be a drawstring type mechanism. For example, closing device 150 can comprise a string 152 that circumscribes the opening 112 through a channel (not shown). The channel can be positioned between the internal surface 104 and the external surface 106. The closing device 150 can reduce the area of the opening by pulling on the opposing ends 153 of the strings 152. To prevent unintentional reopening, string ends 152 can be tied or a pre-tensioned clip can be placed on the strings to prevent movement. It is further contemplated that the closing device 150 can comprise other mechanisms to reduce or increase the size of the bag opening 112. For example, the closing device 150 can include other mechanisms for adjusting the size opening but not limited to: zippers, buttons, snaps and other fasteners for fabrics.

Figure 6:
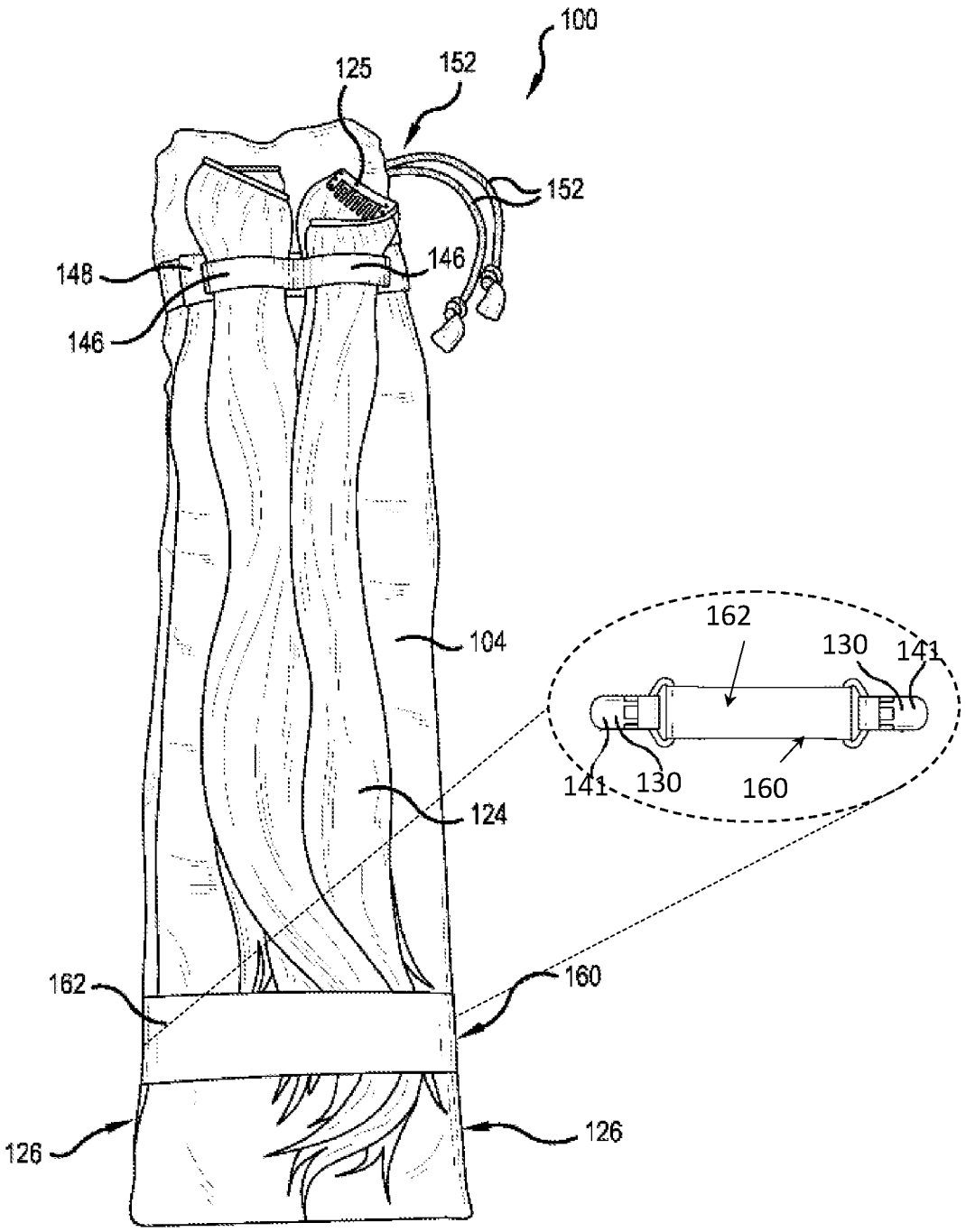
FIG. 6 shows a top perspective view of the illustrative embodiment of FIG. 1 with a hair piece.
Figure 7:
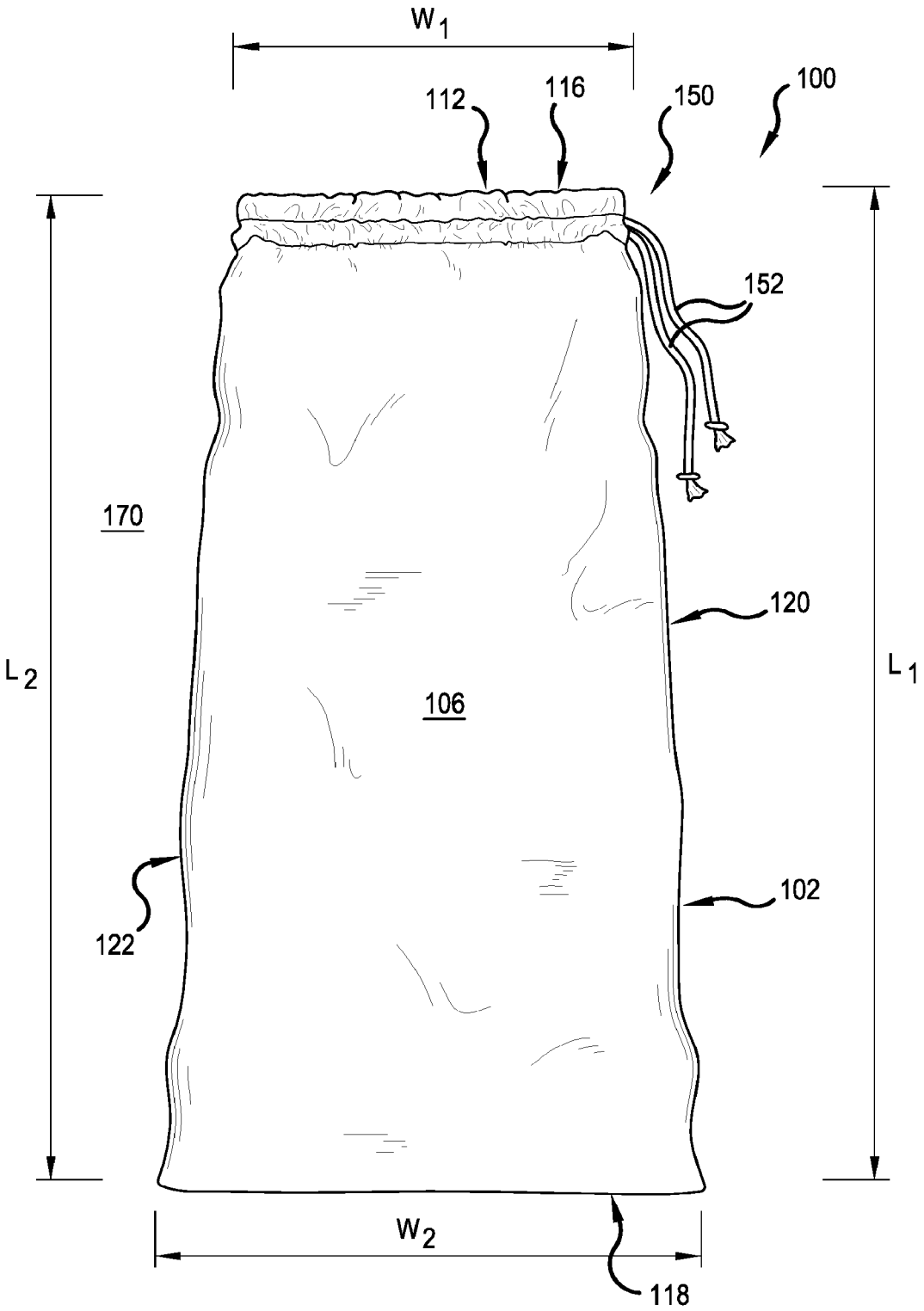
FIG. 7 shows a top perspective view of another illustrative embodiment.

In another aspect of the embodiment as shown in FIG. 6, the embodiment can include a securing system 160 to prevent the hair piece 124 from moving while the bag 102 is collapsed and/or transported. The securing system 160 can comprise an at least one strap 162 coupled to the internal surface 104. In one aspect, the strap can be fixed and attached to the internal surface 104. In another aspect, the strap 160 can be detachable. The detachable strap 162 can have clips attached to the ends of the strap 162. In a further aspect, the securing system 160 can include a plurality of straps 162. The variety of potential placements for the straps 162 or multiple straps 162 allows a user to customize the stabilizing orientation of the hair piece 124 to the internal surface 104.

Figure 12:
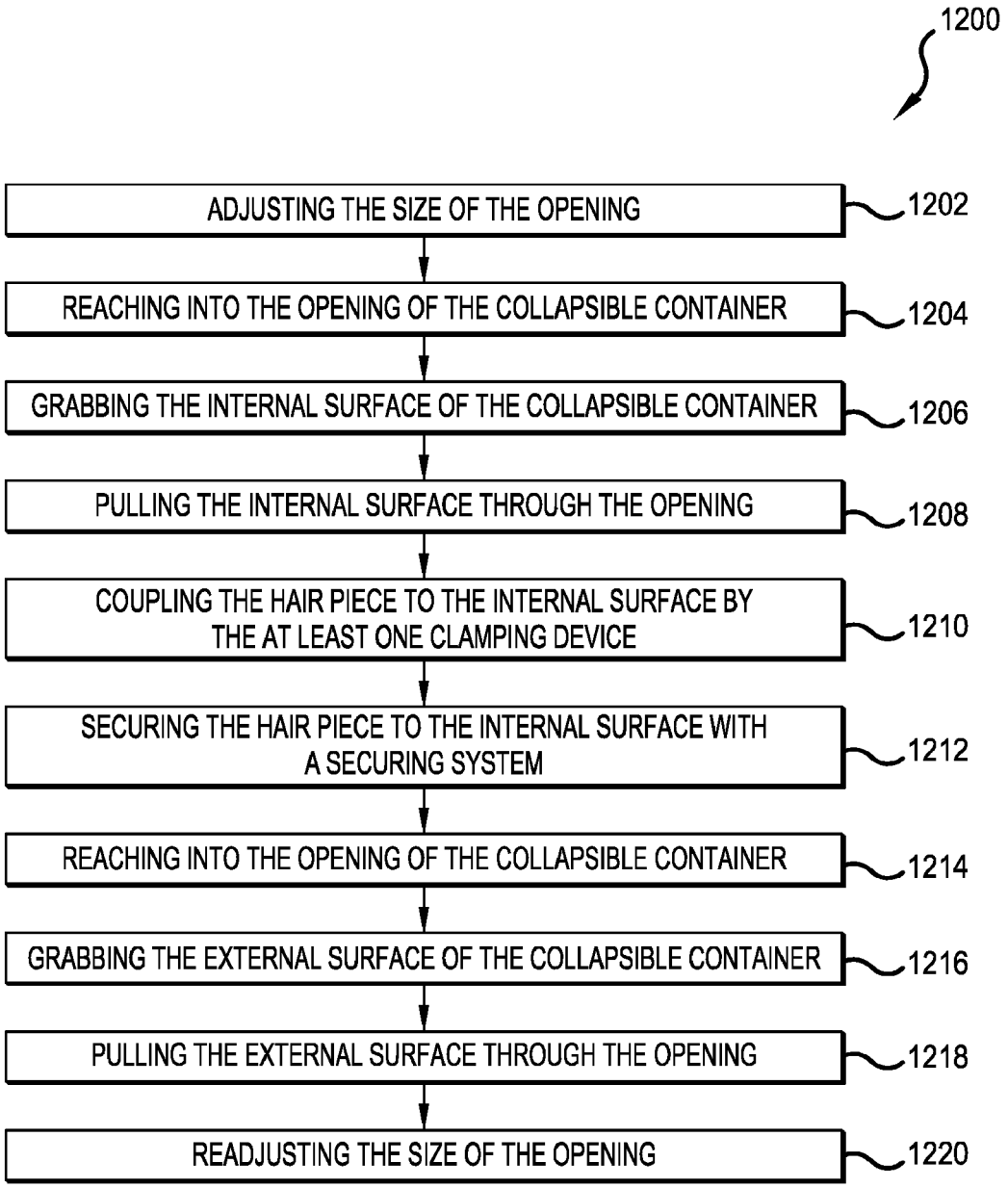
FIG. 12 shows a flow chart for illustrating a method for affixing a hair piece for storage in the illustrative embodiment depicted in FIG. 1.

The operations described and shown in the method of FIG. 12 may be carried out or performed in any suitable order as desired in various embodiments of the disclosure. Additionally, in certain embodiments, at least a portion of the operations may be carried out in parallel. Furthermore, in certain embodiments, less than or more than the operations described in FIG. 12 may be performed. The method 1200 can start in block 1202, and according to an example embodiment of the disclosure, can include adjusting the area of the opening with a closing device. In one aspect of block 1202, a closing device 150 can be used to increase the area of the opening allowing for easier access to the cavity of the container collapsible (bag) 102. In block 1204, the method 1200 can include reaching into the opening of the collapsible container 102. In block 1206, the method 1200 can include grabbing the internal surface 104 of the collapsible container 102. In block 1208, the method 1200 can include pulling the internal surface 104 through the opening 112. In one aspect, completing block 1208 inverts the collapsible container 102 by exposing the internal surface 104 to the exterior space 170. In block 1210, the method 1200 can include coupling the hair piece 124 to the internal surface 104 by the at least one clamping device 130. In block 1212, the method 1200 can include securing the hair piece 104 to the internal surface 104 with a securing system 160. In block 1214, the method 1200 can include reaching into the opening 112 of the collapsible container. In one aspect completing block 1214 can begin the process of reversing the inverted orientation completed in block 1208. In block 1216, the method 1200 can include grabbing the external surface 106 of the collapsible container. In block 1218, the method 1200 can include pulling the external surface 106 through the opening 112. In block 1220, the method 1200 can include readjusting the area of the opening. In one aspect block 1220, readjusting can include using the closing device 150 to decrease the size of the opening, which protects the hair 124 in the container (bag) 102, during storage or travel. In other example embodiments of the disclosure, the method 1200 can include fewer or greater numbers of operations than those described above, and may be performed in a different sequential order than described above.

The disclosure is described above with reference to block and flow diagrams of systems, devices and/or methods, according to example embodiments of the disclosure. It will be understood that some blocks of the block diagrams and flow diagrams may not necessarily need to be performed in the order presented, or may not necessarily need to be performed at all, according to some embodiments of the disclosure.

While the disclosure has been described in connection with what is presently considered to be the most practical and various embodiments, it is to be understood that the disclosure is not to be limited to the disclosed embodiments, but on the contrary, is intended to cover various modifications and equivalent arrangements included within the spirit and scope of the appended claims.

This written description uses examples to disclose the disclosure, including the best mode, and also to enable any person skilled in the art to practice the disclosure, including making and using any devices or systems and performing any incorporated methods. The patentable scope of the disclosure is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A hair carrying device for carrying a hair piece, the hair carrying device comprising:

an invertable bag having an internal surface, an external surface;

a first horizontal strap attached to the internal surface at a top position perpendicular to the plane of the internal surface, wherein the first horizontal strap has one or more loops;

a second horizontal strap attached to the internal surface at a bottom position perpendicular to the plane of the internal surface;

and the hair piece;

wherein the hair piece is positioned along the internal surface of the bag whereby a top portion of the hair piece is secured by the one or more loops of the first horizontal strap and a bottom portion of the hair piece is secured by the second horizontal strap;

wherein the invertable bag is configured to secure the hair piece when the internal surface is exposed outwardly and the external surface is concealed inwardly; and wherein the invertable bag is configured to conceal the secured hair piece in an original position having the internal surface concealed inwardly and the external surface exposed outwardly.

2. The hair carrying device of claim 1, further comprising a closing device, attached to the hair carrying device near an opening, configured to adjust a size of the area of the opening.

3. The hair carrying device of claim 1, wherein the internal surface comprises a non-abrasive material.

4. The hair carrying device of claim 1, wherein the invertable bag is collapsed by rolling an edge of the container along an axis of the invertable bag to reduce folds and entanglements of the hair piece.

5. A hair carrying device comprising:

a hair piece;

a container comprising:

an internal surface attached to an external surface to form a cavity an opening with an area configured wherein the hair piece is positioned through the opening and along the internal surface;

a first horizontal strap attached to the internal surface perpendicular to the plane of the internal surface, wherein the first horizontal strap has one or more fasteners, wherein the first horizontal strap secures an upper portion of the hair piece against the internal surface;

a second horizontal strap attached to the internal surface perpendicular to the plane of the internal surface, wherein the second horizontal strap is positioned below the first horizontal strap, wherein the second horizontal strap secures a lower portion of the hair piece against the internal surface; and a closing device, attached to the hair carrying device near the opening, configured to adjust a size of the area of the opening;

whereby the hair piece is concealed when the external surface is visible and is secured along the internal surface and when inverted, the internal surface is visible with the hair piece secured by the first and second horizontal straps.

6. The hair carrying device of claim 5, wherein the internal surface and the external surface are coupled distally from the opening.

7. The hair carrying device of claim 5, wherein the container is collapsed by rolling an edge of the container along an axis of the container to reduce folds and entanglements of the hair piece.

8. The hair carrying device of claim 5, further comprising wherein the internal surface is pulled through the opening to transition the container from a first configuration to an inverted configuration;

the upper portion of the hair piece is secured with the first horizontal strap and the lower portion of the hair piece is secured with the second horizontal strap; and the external surface is pulled through the opening to transition the container from the inverted configuration to the first configuration.

* * * * *